United States Patent [19]

Banfi

[11] Patent Number: 4,611,187

[45] Date of Patent: Sep. 9, 1986

[54] CIRCUIT BREAKER CONTACT ARM LATCH MECHANISM FOR ELIMINATING CONTACT BOUNCE

[75] Inventor: Claudio Banfi, Rovello Porro, Italy

[73] Assignee: General Electric Company, New York, N.Y.

[21] Appl. No.: 699,271

[22] Filed: Feb. 7, 1985

[30] Foreign Application Priority Data

Feb. 15, 1984 [IT] Italy ..... 19615 A/84

[51] Int. Cl.[4] ..... H01H 77/06

[52] U.S. Cl. ..... 335/16; 335/46

[58] Field of Search ..... 335/16, 46, 195, 15, 335/6

[56] References Cited

U.S. PATENT DOCUMENTS 4,144,513 3/1979 Shaffer et al. ..... 335/46

4,409,573 10/1983 DiMarco et al. ..... 335/16

*Primary Examiner*—L. T. Hix

*Assistant Examiner*—Brian W. Brown

*Attorney, Agent, or Firm*—Richard A. Menelly; Walter C. Bernkopf; Fred Jacob

[57] ABSTRACT

A latching mechanism is arranged to engage one of the movable contact arms upon magnetic repulsion of the contact arms independent of the operating mechanism to prevent the contact arm from re-closing until the operating mechanism has responded. An operating lever reacts with the contact arm latching mechanism to articulate the operating mechanism to trip the breaker after the latching mechanism has fully engaged the contact arm.

8 Claims, 4 Drawing Figures

CIRCUIT BREAKER CONTACT ARM LATCH MECHANISM FOR ELIMINATING CONTACT BOUNCE

BACKGROUND OF THE INVENTION

The invention relates to automatic power circuit breakers in general and, in particular, to a contact arm latch and trip arrangement used in automatic current limiting circuit breakers to avoid contact reclosure after a rapid repulsion of the contact arms upon occurrence of a short circuit. Automatic current limiting circuit breakers are well known as described for example in U.S. Pat. No. 4,375,021 assigned to the common assignee of this invention. In current limting circuit breakers, means are generally provided to motivate one or both of the contact arms under the action of intense electrodynamic repulsion forces generated by short circuit currents.

This is accomplished by arranging the contact arms rotatable with respect to the circuit breaker support structure and providing the arms with return springs of sufficient force to pass operating current. When a short circuit occurs, the electrodynamic repulsion generated within the contact arms, overcomes the return spring force and rotates the contact arms to open the contacts.

However, under intense electrodynamic repulsion, one or both of the contact arms could strike against the contact arm stops provided within the circuit breaker enclosure and rebound back to carry the contacts into their closed position.

Reclosure of the contacts after electrodynamic repulsion should be avoided in a current limiting circuit breaker since the circuit interruption time must be as short as possible to provide the necessary current limitation.

SUMMARY OF THE INVENTION

One purpose of the present invention is to provide a contact arm latching arrangement for engaging one of the contact arms after magnetic repulsion and contact separation upon the occurrence of a short circuit current to prevent contact reclosure caused by the rebound of the contact arm from the contact arm stop.

A further purpose of the present invention is to limit the operation of the contact arm latching to the time span between the opening of the contacts upon electrodynamic repulsion and the intervention of the operating mechanism whereby the contacts become separated.

DESCRIPTION OF THE PREFERRED EMBODIMENT

Figure 1:
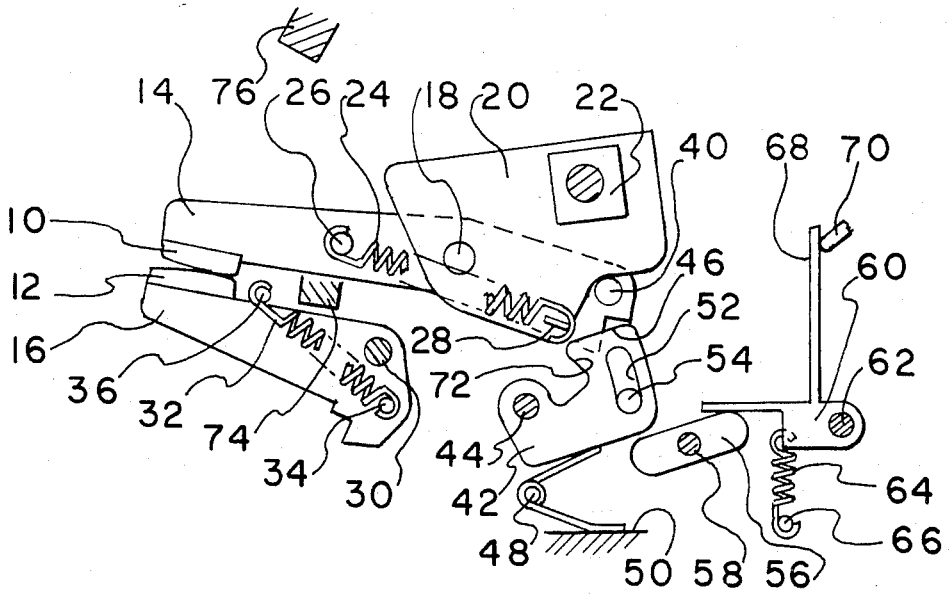
FIG. 1 is a side view of the contact arm latching arrangement of the invention with the circuit breaker contacts in a closed position.

Referring to the figures, it is seen that the circuit breaker incorporating the present invention essentially consists of a first contact 10, called the "load contact", and of a second contact 12, called the "line contact", wherein the first contact is carried by a first movable contact arm 14, and the second contact is carried by a second movable contact arm 16. The contact arm 14 is rotatable around a pivot pin 18 fixed to an operating lever 20, connected to a rotatable shaft 22 operated by a circuit breaker operating mechansim (not shown).

A contact spring 24, engaged at one end to a pin 26 attached to contact arm 14, and at an opposite end to an extension 28 integral with the operating lever 20, biases the contact arm 14 in a counterclockwise direction.

The contact arm 16 is rotatable around a pivot pin 30 attached to the circuit breaker supporting structure and a contact spring 32, engaged at one end to a pin 34 on contact arm 16, and at an opposite end to a pin 36, biases the contact arm 16 in the clockwise direction.

Figure 2:
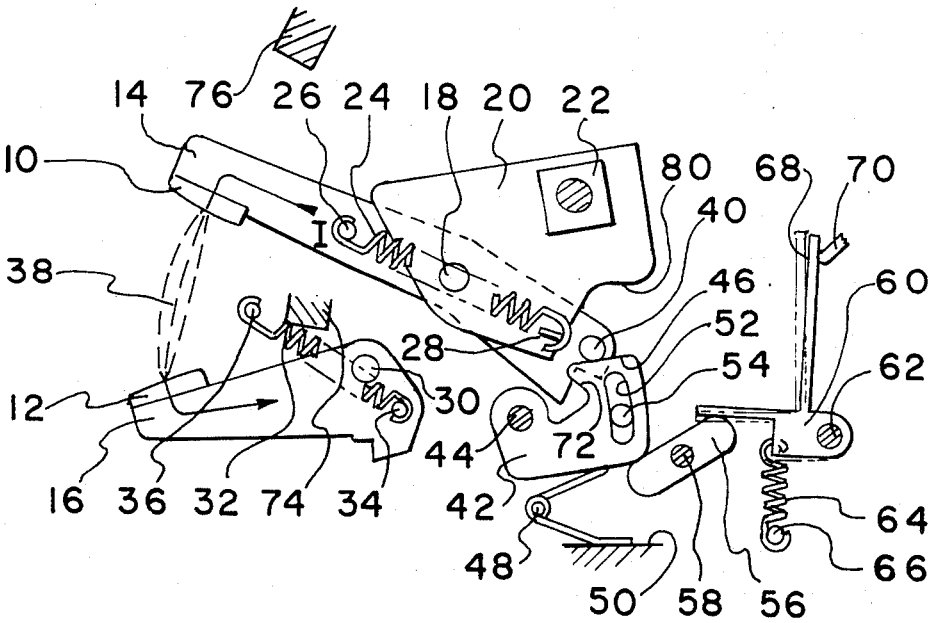
FIG. 2 is a side view of the contact arm latching arrangement shown in FIG. 1 with the circuit breaker contacts separated by electrodynamic repulsion.

When the current passing through the contacts 10, 12 and the associated contact arms 14, 16 reaches a high value such as caused by a short circuit, the electrodynamic repulsion forces developed within the contact arms 14, 16 overcome the action of the contact springs 24, 32, causing the contact arms to repulse each other and the contacts to become separated. The separation of the contacts produces an arc 38 between the contacts as shown in FIG. 2. The electrodynamic repulsion rotates contact arm 14 around its pivot pin 18 until the cam pin 40, fixedly attached to the contact arm at the end opposite the contact, engages a camming surface 46 formed on the contact arm latch 42 causing the latch to rotate about a pivot 44, which is attached to the circuit breaker support structure. The rotation of the latch overcomes the bias of a return spring 48 positioned between the latch 42 and a support 50 on the circuit breaker.

The travel of the latch 42 is limited by an arcuate slot 52 which captures a guide pin 54 attached to the circuit breaker support structure. The latch 42 continues to rotate about pivot pin 44, until engaging a connecting lever 56, which, in turn, becomes rotated about its pivot pin 58, and engages a crank lever 60 rotatably mounted on a pivot pin 62 and retained by a return spring 64 anchored to a pin 66 fixedly attached to the circuit breaker support structure.

The crank lever 60 is provided with an extended arm 68 positioned for actuating the circuit breaker trip lever 70 which, although not shown, is similar to the standard trip bar used in molded case circuit breakers to move the circuit breaker trip latch out of engagement with the circuit breaker cradle to allow the operating mechanism to open the breaker contacts and "trip" the breaker. The displacement of the crank lever 60 and extended arm 68 is best seen in FIG. 2 where the untripped position is indicated in phantom for comparison to the tripped position shown in solid lines.

Figure 3:
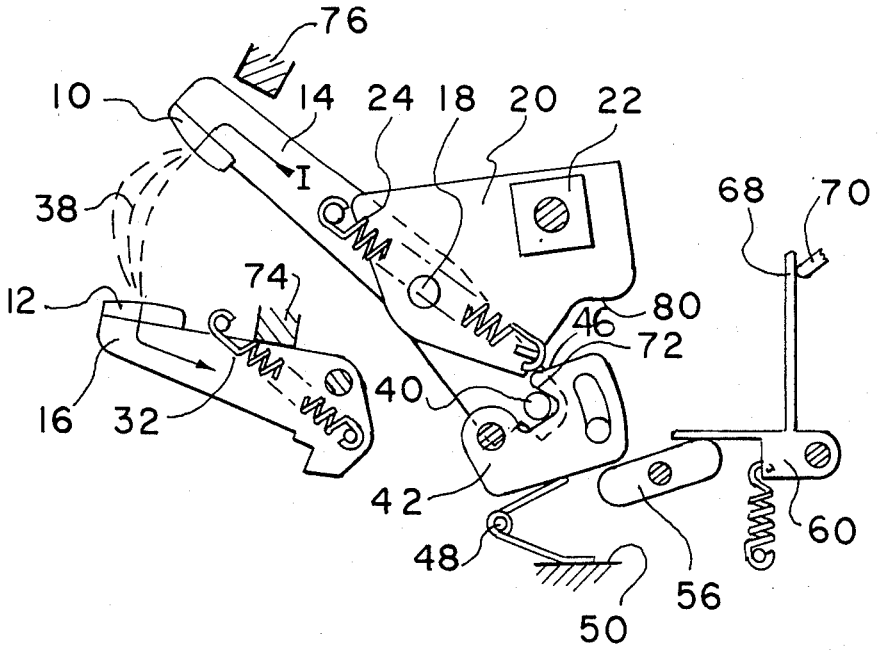
FIG. 3 is a side view of the contact arm latching arrangement shown in FIGS. 1 and 2 with the contact arms latched to prevent contact reclosure.

As shown in FIG. 3, the contact arm 14 is driven against a stop 76 attached to the circuit breaker support structure which would otherwise cause the contact arm to rebound in the reverse direction to re-close the contacts. However, as the contact arm 14 continues to open, pin 40 slides along the surface 46 of the contact arm latch 42 until the projection formed in the latch captures the pin and forces the contact arm latch to rotate in the counterclockwise direction about its pivot pin 44 under the urgence of return spring 48. The engagement of pin 40 by the projection 72 prevents the contact arm 14 from bouncing off stop 76 and rotating in the reverse direction. The arc 38 formed between the contacts upon separation continues to elongate causing further reduction in the short circuit current.

Figure 4:
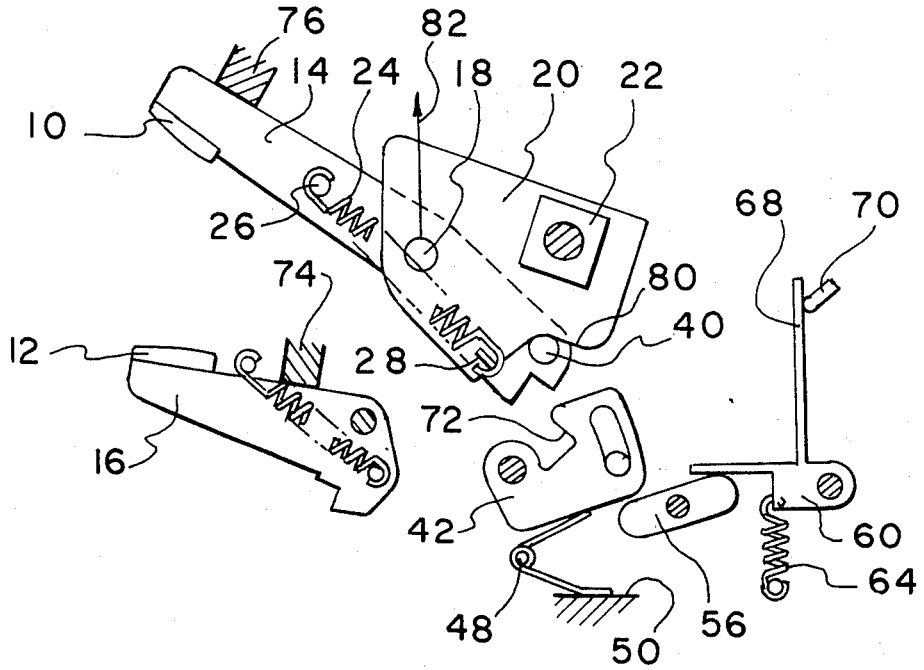
FIG. 4 is a side view of the contact arm latching arrangement of the invention after the intervention of the operating mechanism.

After the contact arm 14 has completed its rotation with the pin 40 retained within the projection 72, as shown in FIG. 4, the operating mechanism responds and exerts a force on the contact arm in the direction indicated by arrow 82. The operating lever 20 is rotated in the clockwise direction under the influence of the shaft 22 which is driven by the circuit breaker operating mechanism. As further shown in FIG. 4, the pin 40 is disengaged from under the projection 72 and moves to a rest position along the camming surface 80 formed on the operating lever 20. As described earlier, the rebound against the contact arm stop 76 in the direction of the bias of the contact spring 24 would otherwise cause the contact arm to move in the opposite direction. The positioning of the pin 40 on the surface 80 of the operating lever 20 further prevents this from occurring.

Having described my invention, what I claim as new and desire to secure by Letters Patent is:

1. A contact arrangment for eliminating contact bounce in current limiting circuit breakers comprising:

a pair of parallel spaced contact arms having a pair of separable contacts arranged at a first end, said contacts being held in a closed position by a pair of contact springs, said contact arms being pivotally mounted within a circuit breaker enclosure to rotate to a first open position independent of an operating mechanism under the influence of magnetic repulsion generated by excess current transport in opposite direction through said contact arms;

a first lever operatively connected with said operating mechanism for rotating one of said contact arms to a second open position after said contact arms are rotated by said magnetic repulsion; and a second lever pivotally mounted within said circuit breaker enclosure against the bias of a first return spring and operatively abutting a second end of said one contact arm opposite said first end and having a camming surface for receiving a cam pin when said one contact arm is rotated to said first open position.

2. The contact arrangement of claim 1 including slot means formed within said second lever for capturing a guide pin attached to said circuit breaker enclosure for limiting travel of said second lever in clockwise and counterclockwise directions.

3. The contact arrangement of claim 1 including a third operating lever pivotally attached within said circuit breaker enclosure intermediate said second lever and a crank lever for contacting with said second lever and with said crank lever to actuate said operating mechanism when said second lever camming surface receives said cam pin.

4. The contact arrangement of claim 1 wherein one of said contact springs is attached to said one contact arm at one end and to said first lever at an opposite end.

5. The contact arrangement of claim 4 including a camming surface on an end of said first lever opposedly adjacent said second lever camming surface for receiving said cam pin when said operating mechanism is actuated for moving said one contact arm to said second open position.

6. The contact arrangement of claim 5 further including a projection formed on said second lever at an end of said second lever camming surface for capturing said cam pin under urgence of said first return spring on said one contact arm to prevent rotation of said one contact arm in an opposite direction.

7. The contact arrangement of claim 3 wherein said crank lever comprises an extended arm in a first plane for contacting with said third lever and an extended arm in a second plane perpendicular to said first plane for contacting with a trip lever.

8. The contact arrangement of claim 7 wherein said crank lever is biased away from said trip lever by a second return spring.

* * * * *